United States Patent [19]

Lüdi et al.

[11] 4,355,292

[45] Oct. 19, 1982

[54] CONTROL DEVICE, PARTICULARLY FOR AUTOMATIC FURNACES

[75] Inventors: Roger Lüdi, Redigäcker; Bernhard Hinni, Regensdorf-Watt, both of Switzerland

[73] Assignee: Satronic AG, Regensdorf, Switzerland

[21] Appl. No.: 231,432

[22] Filed: Feb. 4, 1981

[30] Foreign Application Priority Data

Mar. 11, 1980 [CH] Switzerland ..... 1909/80

[51] Int. Cl.[3] ..... H01H 61/01

[52] U.S. Cl. ..... 335/145; 361/265; 431/66

[58] Field of Search ..... 335/145, 144, 54, 2; 361/265; 431/66, 69, 70, 71

[56] References Cited

U.S. PATENT DOCUMENTS

| | | | |
|---|---|---|---|
| 3,660,005 | 5/1972 | Willson | 431/66 |
| 3,727,158 | 4/1973 | Ludi | 335/145 |
| 3,744,955 | 7/1973 | Tyler et al. | 431/66 |

*Primary Examiner*—Harold Broome

[57] ABSTRACT

A control device for an automatic furnace comprises a relay (2), whose armature (3) has two independent contact holders (4, 5) and a bimetallic element (6) with a control arm (7). By means of snap switches a contact holder (4), a contact holder (8) for operating an ignition device and a contact holder (9) for disconnecting the control device are connected to control arm (7). The minimum spacing between the two armature parts (4, 5) is defined by a bar (15) on armature part (5). If flame formation fails in the furnace, bimetallic element (6) is energized until the control device is switched off by switching over contact holder (9). If a photoelectric cell controlling the switching on of relay (2) becomes conductive due to outside light during the starting and repetition of the control device, the bimetallic element (6) cannot be disconnected by the locking system formed by bar (15) when the fuel valve is closed. By subdividing armature (3) into two contact holders (4, 5) the adjustment of the control elements is simplified and the use of a lower power relay (2) is made possible, because contact holders (4, 5) are mechanically held in their operating position.

3 Claims, 6 Drawing Figures

CONTROL DEVICE, PARTICULARLY FOR AUTOMATIC FURNACES

BACKGROUND OF THE INVENTION

The invention relates to a control device, particularly for automatic furnaces, with an actuating member in the form of a bimetal for actuating control contacts and an electromagnetic relay operated by a furnace protection system.

Various constructions of the aforementioned control devices are known. In one known construction of such a control device (German Pat. No. 21 34 407) a relay controlled by a furnace protection system is used, whose transfer element is pivotably supported on the relay armature for operating the contact set. The contact set is only operated if the transfer element is brought into the operating position by an actuating member, e.g. a bimetallic element. Although this control device has become widely used, over the years it has proved desirable to simplify the adjustment and reduce the cost of the control device.

BRIEF SUMMARY OF THE INVENTION

The problem of the present invention is to so develop a control device of the aforementioned type that adjustment expenditure is reduced and at least in part simpler and/or cheaper components can be used.

According to the invention this problem is solved by making the armature of the electromagnetic relay in two independent armature parts serving as contact holders, whereof one part is operable by the bimetallic element and the other part by the relay. As a result, each of said armature parts can be individually adjusted and the relay can be kept small, because it is only used for opening the contact for which process correspondingly small forces are required.

BRIEF DESCRIPTION OF THE DRAWINGS

The invention is described in greater detail hereinafter relative to a non-limitative embodiment and with reference to the attached drawings, wherein show:

FIG. 4 during fault clearing; FIG. 5 in the case of outside light during starting and repetition; and FIG. 6 during fault clearing with outside light.

DETAILED DESCRIPTION OF A PREFERRED EMBODIMENT

Figure 1:
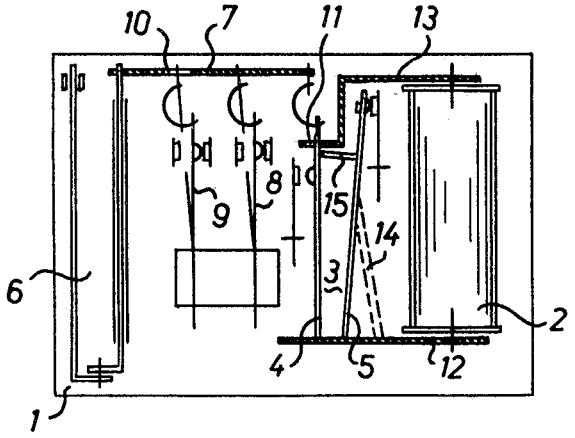
FIG. 1—a control device for an automatic furnace.

FIG. 1 shows a base 1 on which are arranged the components of a control device, as can be used for automatic furnaces for oil and gas burners. These comprise an electromagnetic relay 2 with which is associated an armature 3 supported on a lower yoke member 12, a bimetallic element 6 and a contact set. The armature 3 comprises two elastically movable contact holders 4, 5. Contact holder 4 which belongs to a contact set for operating a fuel valve 23 is called the valve armature part and contact holder 5 belonging to a contact set for operating the bimetallic element 6 is called the bimetal armature part.

The bimetallic element 6 positioned on base 1 carries a control arm 7 with which cooperate contact holders 8, 9 elastically movable by resilient snap switches. The contact holder 8 belongs to a contact set for operating an ignition device 21 (FIG. 2) and contact holder 9 to a contact set for fault clearing. The latter projects into a recess 10 of control arm 7, so that delayed operation is obtained.

The valve armature part 4 is connected via a resilient snap switch to control arm 7. It projects into a recess 11 of an upper fixed yoke member 13 and engages on one or other edge of said recess. Bimetal armature part 5 carries a projecting bar 15 fixed below the upper yoke member 13 and the function thereof will be described hereinafter.

Figure 2:
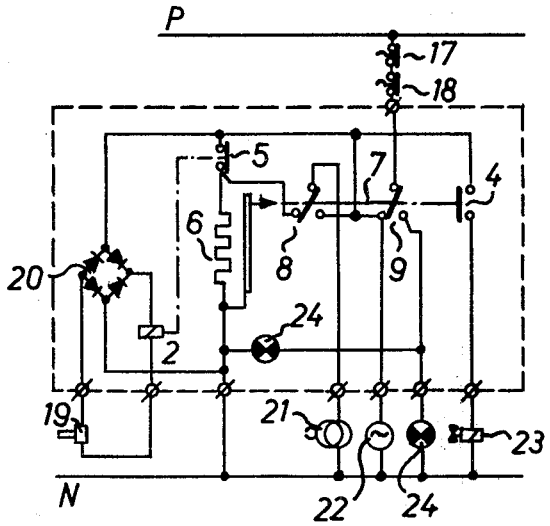
FIG. 2—a circuit diagram of the control device of FIG. 1.

The circuit diagram for the control device of FIG. 1 is shown in FIG. 2. Components 2 and 4–9 are identical to those of FIG. 1. A phase conductor P of a voltage supply is connected by means of switches 17, 18, e.g. thermostats, to the control device, the neutral conductor being designated N. 19 is a photoelectric cells, 20 a rectifier, 21 the ignition device, 22 a motor for driving the blower and the oil pump of a burner, 23 the fuel valve and 24 a spurious signal.

If switches 17 and 18 are closed (cf. FIG. 2) burner motor 22 is energized via contact holder 9, bimetallic element 6 via contact holder 5 and ignition device 21 via contact holders 9, 8. Support arm 7 is displaced in the direction of relay 2 (FIG. 1) due to the heating of bimetallic element 6. This displacement of support arm 7 is transferred to the ignition contact holder 8 and to the valve armature part 4. The position of the control elements on starting is shown in FIGS. 1 and 2.

Figure 3:
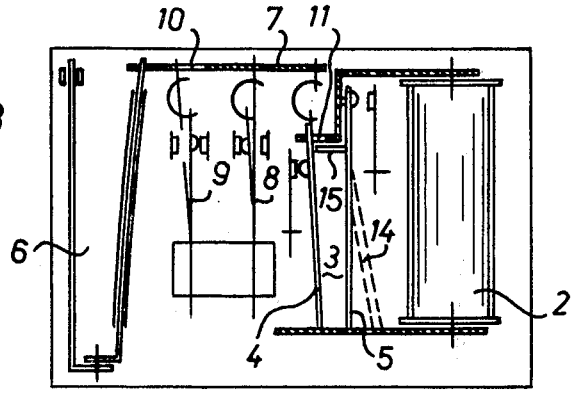
FIGS. 3 to 6—the control device according to FIG. 1 in the different operating phases, and specifically, FIG. 3 during flame formation and retarded ignition.

On further displacement of support arm 7 the ignition contact holder 8 and with a certain delay the valve armature part 4 are switched over by the corresponding snap switch. Ignition device 21 remains switched on, while with a corresponding delay fuel valve 23 is opened, so that the burner is ignited. This state can be gathered from FIG. 2 when ignition contact holder 8 is pivoted into the opposite position and the contact of valve armature part 4 is closed. Bimetallic element 6 is still energized. The resistance of photoelectric cell 19 is reduced due to the burner flame, so that relay 2 is operated and the previously closed contact set of the bimetal armature part 5 (cf. FIG. 1) is opened counter to the action of a spring 14. As a result the bimetallic element is cooled and returns to the initial position. With a certain time lag the ignition contact holder 8 is brought into the position which switches off the ignition device 21, corresponding to the required retarded ignition. The position of the control elements just prior to the switching off of ignition device 21 can be gathered from FIG. 3. After switching over the ignition contact holder 8 into the position shown in FIG. 1 the normal operating position is reached in which both the valve armature part 4 and the bimetal armature part 5 are magnetically held in the operating position.

Figure 4:
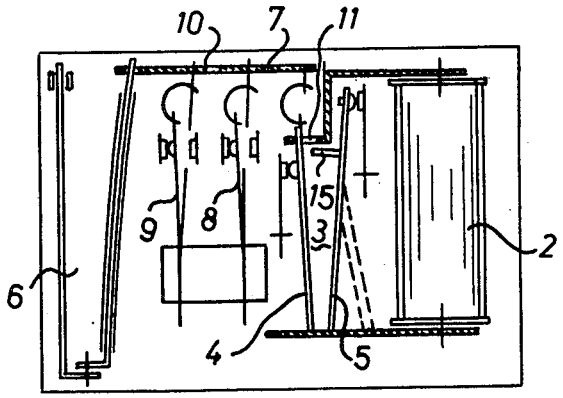

If satisfactory flame formation does not take place, e.g. an intermittent or interrupted flame is obtained, relay 2 cannot be switched and starting is repeated or fault clearing takes place (cf. FIG. 4).

If there is no flame formation, which can occur on starting or during repetition, photoelectric cell 19 is non-conductive and relay 2 cannot be switched, so that bimetallic element 6 is energized via the closed contact set of the bimetal armature part 5. Thus, support arm 7 is further displaced until the contact holder 9 engages on the edge of recess 10 and is reversed by the associated snap switch, so that the complete burner is switched off and operation is stopped.

Figure 5:
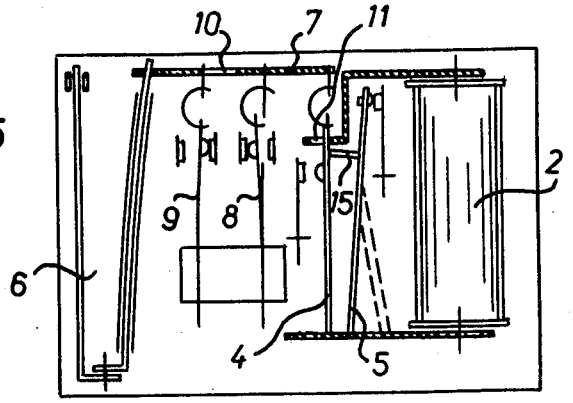
Figure 6:
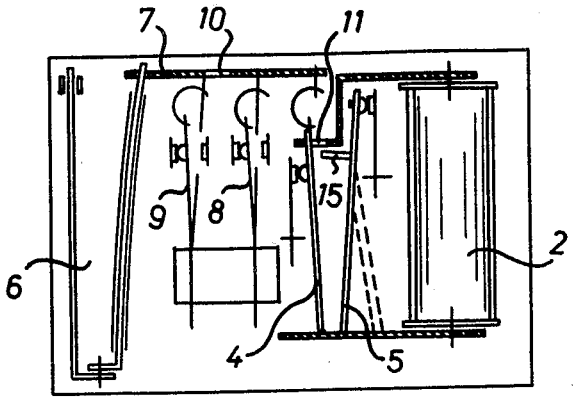

Outside light is another fault source. FIG. 5 shows the effect of outside light during starting and repetition, i.e. with bimetallic element 6 switches on and fuel valve 23 still closed. Due to the outside light photoelectric cell 19 becomes conductive and as a result the relay 2 is switched on. Thus, the valve armature part 4 in the inoperative position is kept magnetic, but there can be no interruption of the contact set of bimetal armature part 5 due to the bar 15 arranged on the latter. Thus, bar 15 forms a mechanical locking means preventing the disconnection of bimetallic element 6. As a result support arm 7 is further displaced, accompanied by the disconnection of the complete burner by switching over the contact holder 9 (cf. FIG. 6). FIG. 6 shows the control device immediately after the disconnection of burner motor 22 when relay 2 is switched off in addition to motor 22. It is unimportant that the valve armature part 4 remains in the operative position, because the burner motor 22 has already been switched off.

In the above-described control device the requirements made thereon are fulfilled with minimum expenditure on control components. By subdividing the relay armature into two parts 4, 5 only a single contact is switched, i.e. the contact of the bimetal armature part 5 and specifically only for contact interruption, so that only a relatively limited switching force is required. The two armature parts 4, 5 are magnetically fixed in the operating position. In addition, when outside light occurs during starting and repetition, fault clearance takes place when the valve armature part 4 is in its inoperative position and consequently fuel valve 22 is closed.

What is claimed is:

1. A control device for an apparatus having an ignition device, a fault clearing device, and a fuel valve, said control device comprising: a bimetallic element for actuating a contact connected to said ignition device and for actuating a contact connected to said fault clearing device; an electromagnetic relay having first and second yoke members and an armature supported on said first yoke member and cooperating with said second yoke member, said armature comprising a first part having a contact connected to said fuel valve and projecting into a recess in said second yoke member and being magnetically secured at one of two opposed edges of the recess when the relay is energized, said first part being operably connected to said bimetallic element, said armature also comprising a second part having a contact connected to said bimetallic element and having a projecting bar defining the minimum space between said two parts, such that said second part is magnetically secured to said second yoke member to disconnect said bimetallic element when said first part is in the position to open said fuel valve.

2. A control device according to claim 1, wherein said bimetallic element has a control arm, and snap switches connected to said control arm and respectively to said first armature part and said contact for actuating said ignition device.

3. A control device according to claim 2, wherein said control arm has a recess, and a snap switch connected to said contact of said fault clearing device and extending into said recess of said control arm.

* * * * *